US006897366B2

(12) United States Patent
McPherson

(10) Patent No.: US 6,897,366 B2
(45) Date of Patent: May 24, 2005

(54) NECK CONNECTION FOR STRINGED MUSICAL INSTRUMENT

(75) Inventor: Mathew McPherson, Norwalk, WI (US)

(73) Assignee: Mathew A. McPherson, Norwalk, WI (US)

( * ) Notice: Subject to any disclaimer, the term of this patent is extended or adjusted under 35 U.S.C. 154(b) by 174 days.

(21) Appl. No.: 10/304,155

(22) Filed: Nov. 26, 2002

(65) Prior Publication Data

US 2004/0099122 A1 May 27, 2004

(51) Int. Cl.[7] ..... G10D 3/00

(52) U.S. Cl. ..... 84/293; 84/290; 84/291; 84/267

(58) Field of Search ..... 84/290, 267, 280, 84/293, 291, 292

(56) References Cited

U.S. PATENT DOCUMENTS

| | | | | |
|---|---|---|---|---|
| 635,872 | A | | 10/1899 | Scmidtlein |
| 1,747,307 | A | | 2/1930 | Leland et al. |
| 1,959,530 | A | | 5/1934 | Gerber |
| 2,523,963 | A | | 9/1950 | Mitchell ..... 84/267 |
| 3,539,699 | A | | 11/1970 | Johnson ..... 84/1.16 |
| 3,869,954 | A | | 3/1975 | Ito ..... 84/291 |
| 3,974,730 | A | | 8/1976 | Adams, Jr. ..... 84/291 |
| 4,056,034 | A | | 11/1977 | Kaman ..... 84/267 |
| 4,090,427 | A | | 5/1978 | Kaman ..... 84/291 |
| 4,178,827 | A | | 12/1979 | Mallory ..... 84/291 |
| 4,291,606 | A | | 9/1981 | Lepage ..... 84/291 |
| 4,317,402 | A | | 3/1982 | McPherson, Sr. ..... 84/291 |
| 4,320,684 | A | | 3/1982 | Podunavac ..... 84/291 |
| D270,735 | S | | 9/1983 | McPherson, Sr. ..... D17/20 |
| 4,407,181 | A | | 10/1983 | Thomas ..... 84/275 |
| 4,467,692 | A | | 8/1984 | Egan ..... 84/291 |
| 4,681,009 | A | | 7/1987 | Mouradian ..... 84/293 |
| 4,796,504 | A | | 1/1989 | McWillis ..... 84/265 |
| 4,836,076 | A | | 6/1989 | Bernier ..... 84/275 |
| 4,846,039 | A | | 7/1989 | Mosher ..... 84/293 |
| 4,873,907 | A | | 10/1989 | Decker, Jr. et al. ..... 84/291 |
| 4,877,070 | A | | 10/1989 | Hayashi ..... 144/364 |
| 4,941,389 | A | | 7/1990 | Wendler ..... 84/727 |
| 5,170,000 | A | | 12/1992 | Hayashida et al. ..... 84/192 |
| 5,171,926 | A | | 12/1992 | Besnainou et al. ..... 84/275 |
| 5,320,018 | A | | 6/1994 | Fandrich ..... 84/195 |
| 5,333,527 | A | | 8/1994 | Janes et al. ..... 84/291 |
| 5,353,672 | A | * | 10/1994 | Stewart ..... 84/291 |
| 5,406,874 | A | | 4/1995 | Witchel ..... 84/291 |
| 5,585,579 | A | | 12/1996 | Ignatius ..... 84/192 |
| 5,952,592 | A | | 9/1999 | Teel ..... 84/291 |
| 5,990,396 | A | | 11/1999 | Lasner ..... 84/293 |
| 6,051,765 | A | * | 4/2000 | Regenberg et al. ..... 84/293 |
| 6,100,458 | A | | 8/2000 | Carrington ..... 84/293 |
| 6,350,939 | B1 | * | 2/2002 | Griffiths ..... 84/293 |

FOREIGN PATENT DOCUMENTS

| | | |
|---|---|---|
| FR | 2 529 363 | 6/1982 |

* cited by examiner

*Primary Examiner*—Kimberly Lockett
(74) *Attorney, Agent, or Firm*—Vidas,Arrett&Steinkraus

(57) ABSTRACT

A stringed musical instrument having, a body portion and a neck connected thereto. The neck connection utilizes a neck block which has an angled surface into which connection bolts are inserted to secure the neck to the body. The angled surface results in offset bolts which resist loosening and provides for an angled force for a more stable connection between the neck and the body.

11 Claims, 7 Drawing Sheets

FIG. 1
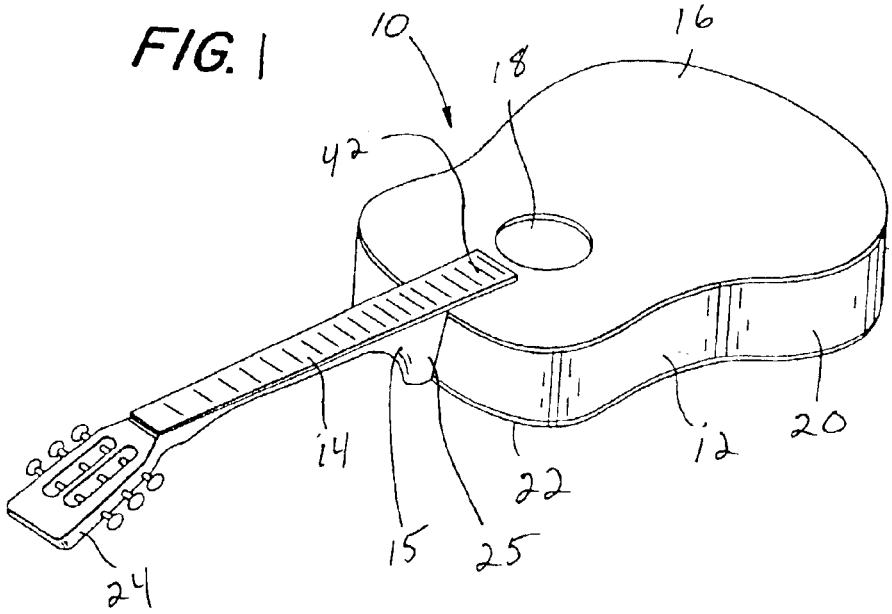
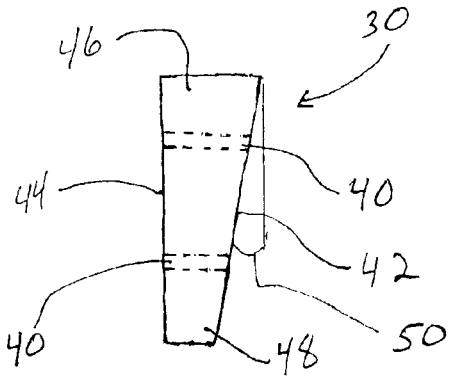
Fig 5
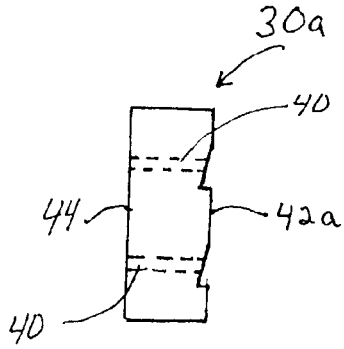
Fig 5a

NECK CONNECTION FOR STRINGED MUSICAL INSTRUMENT

FIELD OF THE INVENTION

This invention relates to the construction of a stringed musical instrument, and more particularly to the connection between the neck and the body of the instrument.

BACKGROUND OF THE INVENTION

The present invention applies to a variety of stringed instruments, however, for purposes of description, a typical acoustic guitar is used as an example.

A typical acoustic guitar has a hollow body or sound box connected to a neck. The hollow body has a soundboard with a sound hole, a back or bottom board spaced from the soundboard, and a shaped side wall which connects between the soundboard and backboard.

The acoustic guitar has a series of strings strung at substantial tension from a bridge on the soundboard, across the sound hole, and along the neck. The string tension creates forces which act on the neck, the connection between the neck and the body and the soundboard and which, over time, can cause bending, cracking or other damage. The damage can result in structural failure and altered intonation of the acoustic guitar.

Traditionally, necks of stringed instruments have been directly connected to the body of the guitar. The guitar typically has a flat surfaced neck block just on the inside of the side wall of the body to provide extra structure support to support the neck. The neck block is positioned just opposite of the end of the neck which is to be connected to the body of the guitar. The side wall of the body of the guitar is sandwiched therebetween.

Due to typical handling and the tension applied by the strings, stresses on the connection between the neck and the body can eventually compromise the integrity of the guitar. This results not only in basic structural damage, but also deterioration of the tonal quality of the guitar. The connection between the neck and the body should therefore be strong and stable.

All U.S. patents and applications all other published documents mentioned anywhere in this application are incorporated herein by reference in their entirety.

Without limiting the scope of the invention in any way, the invention is briefly summarized in some of its aspects below.

SUMMARY OF THE INVENTION

In accordance with these objectives, the present invention is directed to a stringed musical instrument having a neck connected to a body, or sound box. The present invention provides superior strength and stability, yet which still retains the response and appearance associated with traditional wooden necks. In the present invention, the outer face surface of neck block is angled, such that bolts which are tightened into the block are offset. This creates an angled force which urges the body of the instrument into the corner created by the neck attachment portion and also prevents the bolts from loosening. The connection design provides a stable and solid connection between the neck and the body of the instrument which is resistant to vertical movement or loosening of the bolts.

BRIEF DESCRIPTION OF THE DRAWINGS

FIG. 1 is a perspective view of an acoustic guitar;

FIG. 5 is a side view of the neck block;

FIG. 5*a* is a side view of a further embodiment of the neck block;

DESCRIPTION OF THE PREFERRED EMBODIMENT

Figure 2:
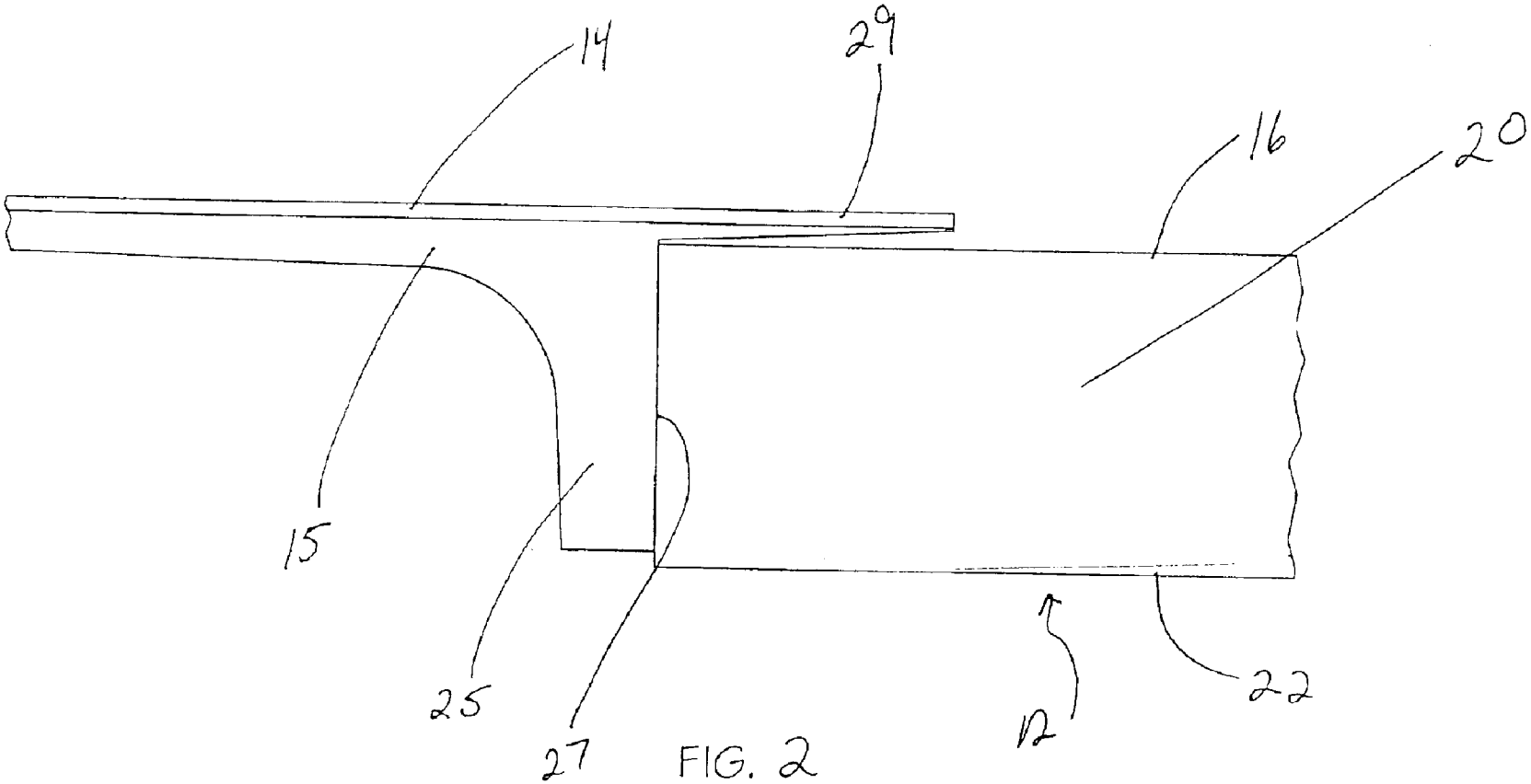
FIG. 2 shows a partial side view of the guitar.

While this invention may be embodied in many different forms, there are shown in the drawings and described in detail herein specific embodiments of the invention. The present disclosure is an exemplification of the principles of the invention and is not intended to limit the invention to the particular embodiments illustrated.

For the purposes of this disclosure, unless otherwise indicated, identical reference numerals used in different figures refer to the same component.

This invention relates to the attachment of the neck to the body of a stringed instrument. For purposes of description, an acoustic guitar is used for illustrative purposes.

Referring now to the drawings, FIG. 1 illustrates an acoustic guitar 10 having a hollow body 12 and a neck 15 having a finger board or fret board 14. The body has a soundboard 16 with a sound hole 18. The soundboard 16 is connected to sidewall 20 which, in turn, is connected to a backboard 22. The neck 14 has a headstock 24, a tongue 29 and a connection brace 25, and strings (not shown) are strung from the headstock 24 in a direction along the neck 14, across the sound hole 18 and to a bridge (not shown) on the soundboard 16.

FIG. 2 shows a closer side view of the attachment of the neck 15 to the body 12. The connection brace 25 is flushly connected to the body 12 against the side wall 20 at point 27. It can be seen that the tongue 29 is not connected to the body 12 or the sound board 16.

Figure 3:
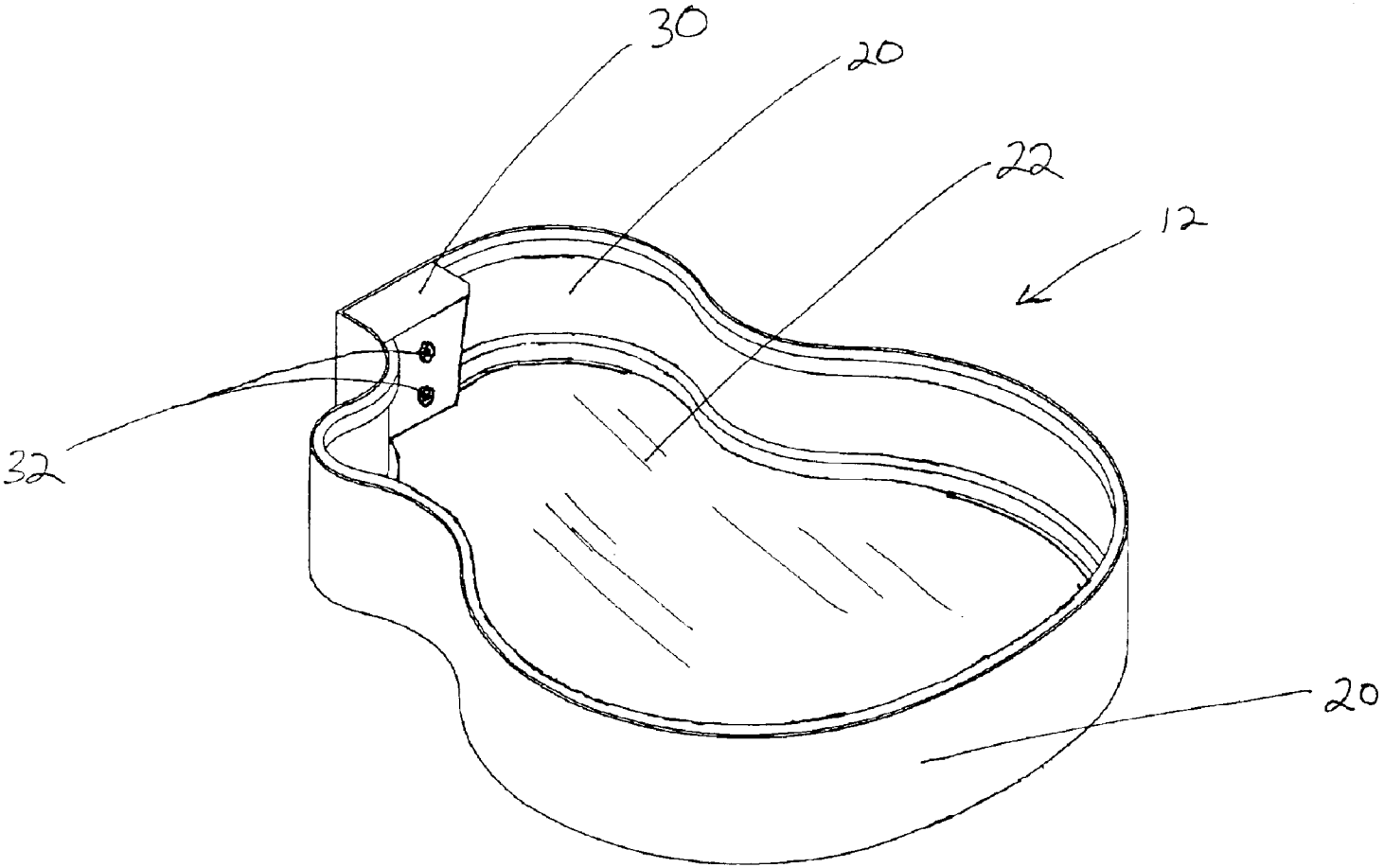
FIG. 3 shows a perspective view of the body of the guitar with the sound board removed.

FIG. 3 shows the inside of the body 12. From this view one can see the neck block 30, which is part of the connection to the neck 15. The neck block 30 acts as a stabilizer and a solid body to which the neck 15 is connected. Although the body has a slightly different shape than the body of FIG. 1, the concept is the same. Typically bolts are used to fasten the body 12 to the neck 15. The ends of the bolts 32 are shown in the neck block 30.

The neck block 30 may be made of any suitable material which may receive a properly sized bolt and support he weight and size of a conventional neck. Typically, the neck block 30 is made of wood.

Figure 3A:
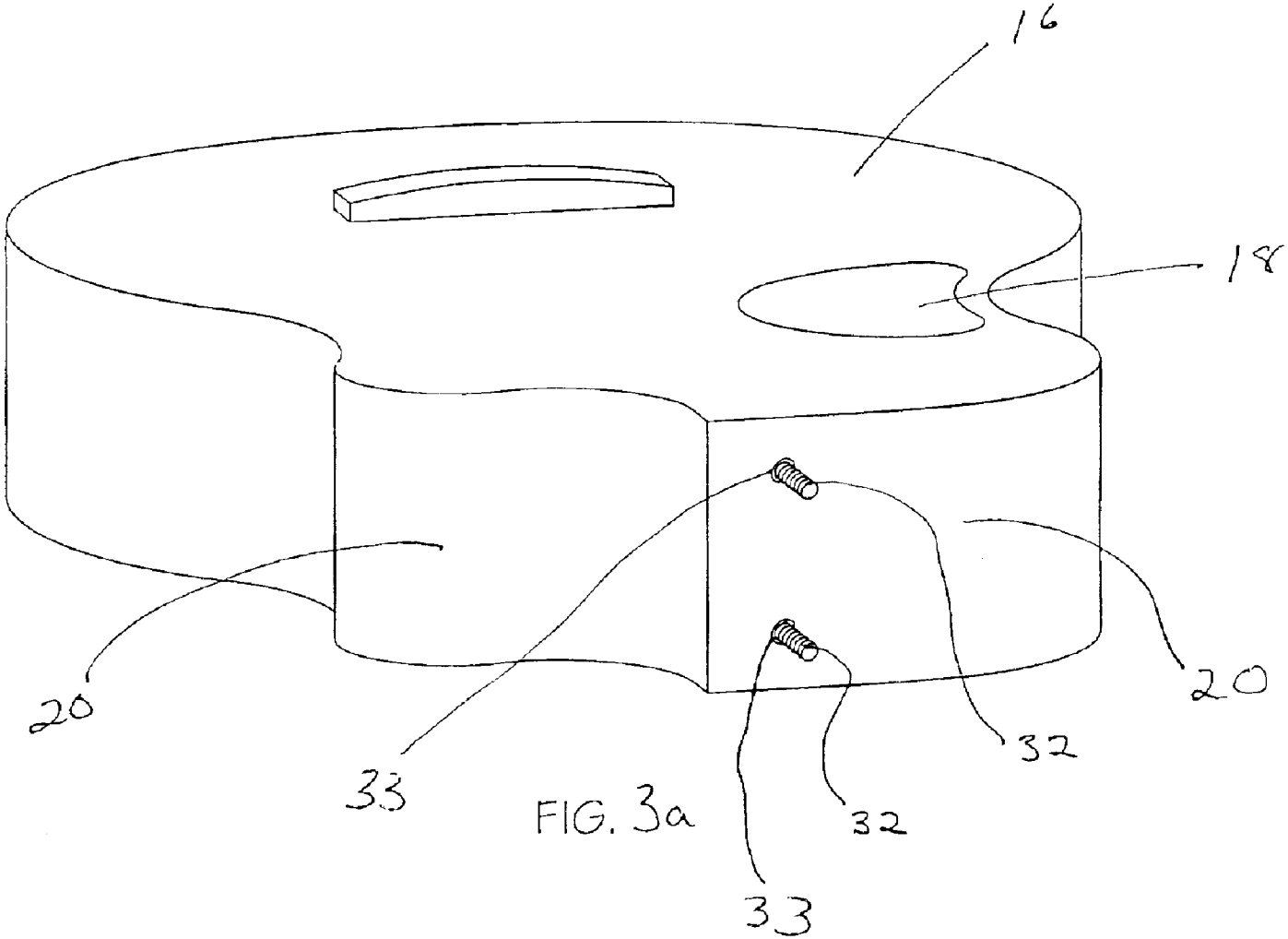
FIG. 3*a* shows a perspective view of the body of the guitar.

FIG. 3*a* shows an elevated side view of the upper bout of the body 12 and the extensions of the bolts 32 through holes 33 in the side wall 20. As discussed below, these bolts 32 provide for the attachment mechanism to the neck 15.

Figure 4:
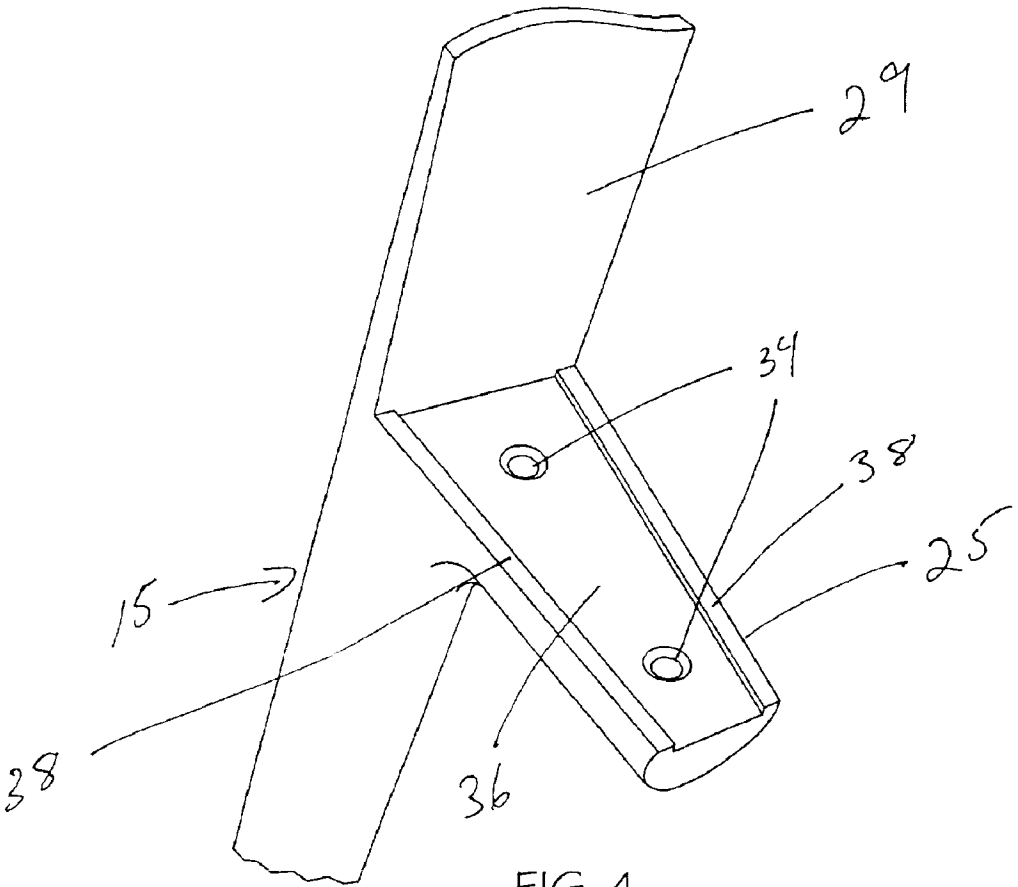
FIG. 4 shows a partial perspective view of the end of the guitar neck.

FIG. 4 illustrates an end portion of the neck 15 which is connected to the body 12. The tongue 29 and the connection brace 25 are illustrated. The connection brace 25 includes holes 34 to receive the connection bolts 32. The holes 34 are typically threaded. It should be understood that other conventional forms of connection may be employed, such as, but not limited to, screws and nuts and bolts. In the embodiment shown, threaded bolts 32 and threaded holes 34 are used. Also in the shown embodiment, a face 36 is inset from margins 38, which are pressed flush against the body 12 of the guitar.

FIG. 5 illustrates a side view of the configuration of the neck block 30. The neck block 30 is made of material which has sufficient strength and stability to support the load of the neck 15. Materials include wood and any synthetic material used in conventional instrument making. The neck block is provided with bored holes 40 to receive the bolts 32.

As can be seen in FIG. 5, the front surface 42 is slanted relative to the back side 44, such that the thickness of the block decreases from the top 46 to the bottom 48. An angle 50 is created by the slant of the block. The angle is between 0° and 45°.

Although the slant of the block is shown as a gradual slant, it should be understood that the invention contemplates an embodiment in which the slanted surface is only in the area of the bolt insertion point or hole 40, such as shown in FIG. 5*a*.

Figure 6:
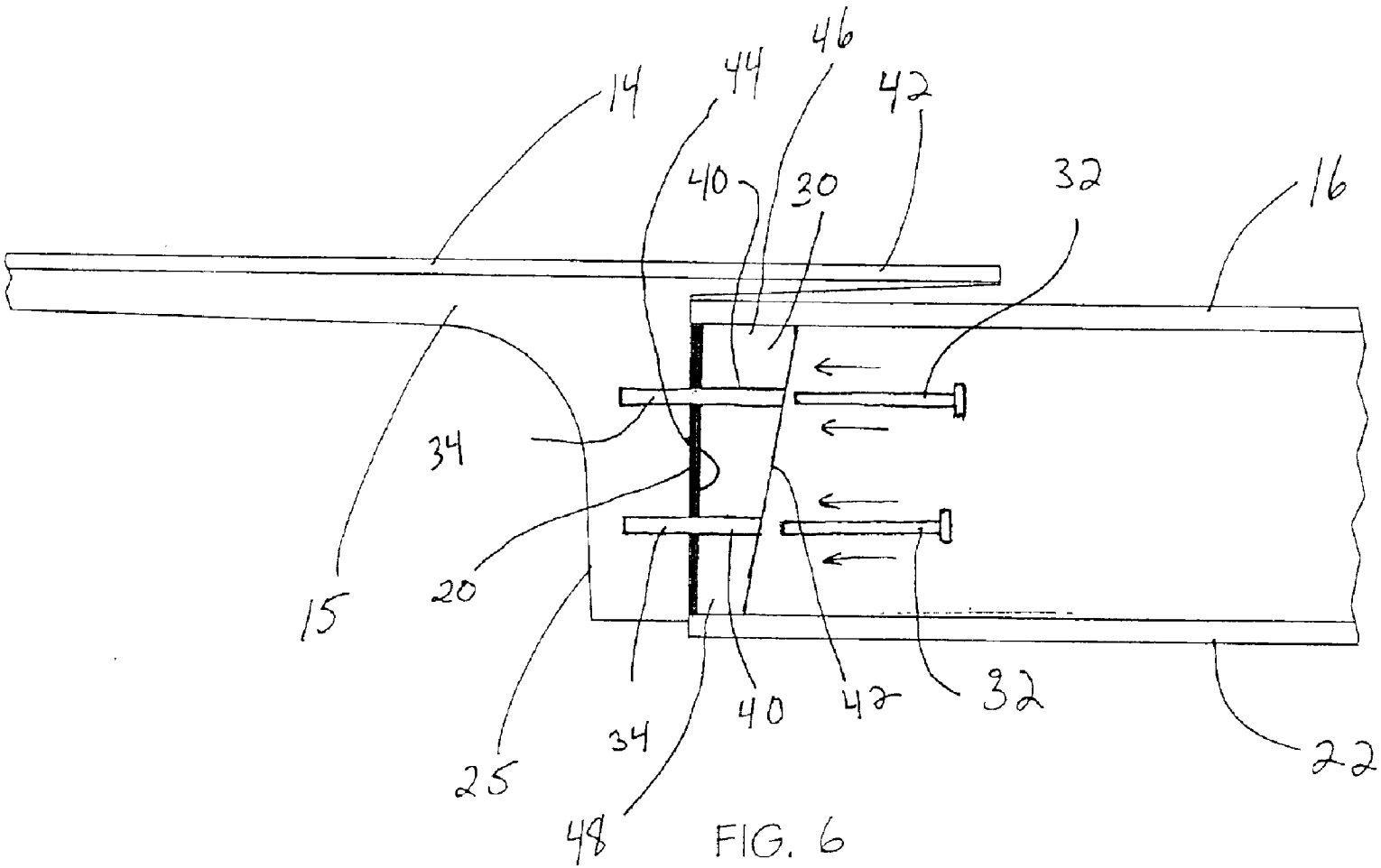
FIG. 6 is a cross-sectional view of the connection between the neck and the body, wherein the connection bolts are removed.

FIG. 6 shows a cross-section of the guitar illustrating the connection of the neck 15 to the body 12. As can be seen, the block 30 is inside the body 12, flush against the side wall 20, opposite the face 36 of the connection brace 25. Holes 40 of the block 30 are aligned with holes 34 of the connection brace 25 to receive the bolts 32.

Figure 7:
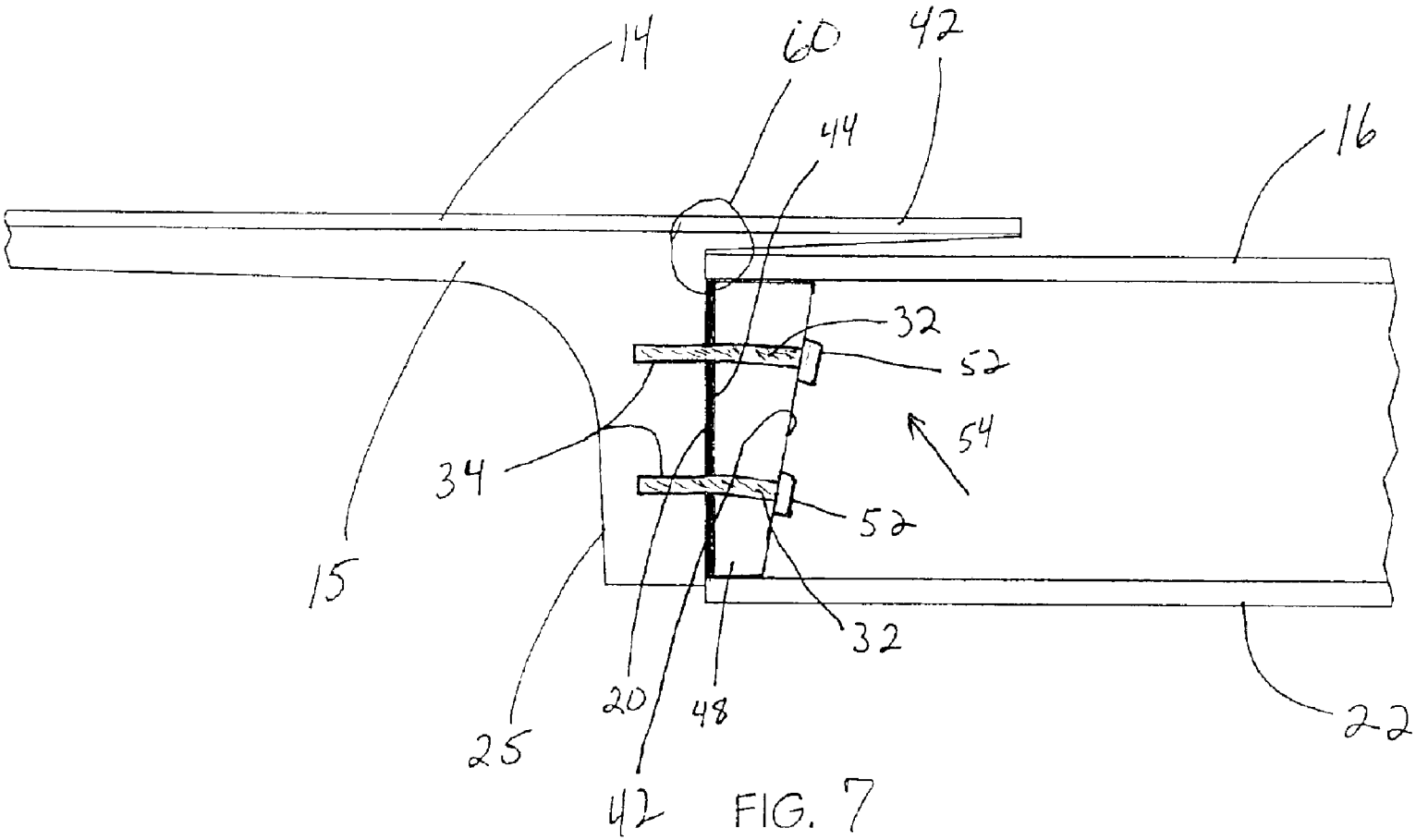
FIG. 7 is a cross-sectional view of the connection between the neck and the body.

FIG. 7 shows the embodiment wherein the bolts 32 are screwed into place. In this figure, the bolts near their heads 52 appear slightly angled. This is somewhat of a distortion to illustrate the angled force 54 created by the bolts 32 and the offset nature of the heads of the bolts when they are tightened against the slanted surface 42 of the block. The holes in the neck block and the connection brace are straight.

When the heads 52 of the bolts 32 are tighten against the slanted surface 42 of the block 30, they become angled or offset to conform to the surface 42. This creates an angled force 54, which urges the block 30 and the side wall 20 of the body 12, which is sandwich between the block 30 and the connection brace 25, firmly against the margins 38 of the connection brace 25 and, at the same time, into the corner 60 created by the connection brace 25 and the tongue 42. This creates a tighter and more stable connection between the neck 15 and the body 12 and removes unwanted vertical movement of the body relative to the connection brace 25 without connecting the tongue 42 to the body 12.

The offset nature of the bolts also prevents loosening of the bolts, which may be a problem with flat or non-angled surfaces into which bolts are screwed into.

In addition to being directed to the embodiments described above and claimed below, the present invention is further directed to embodiments having different combinations of the dependent features described above and/or claimed below.

Every patent, application or publication mentioned above is herein incorporated by reference.

The above examples and disclosure are intended to be illustrative and not exhaustive. These examples and description will suggest many variations and alternatives to one of ordinary skill in this art. All these alternatives and variations are intended to be included within the scope of the claims, where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each single dependent claim format which creates a dependency from a prior antecedent-possessing claim other than the specific claim listed in such dependent claim below (e.g. claim 6 may be taken as alternatively dependent from any of claims 2–5, claim 4 may be taken as alternatively dependent from claim 3; etc.).

What is claimed is as follows:

1. An instrument comprising:

a body having an inside, a top, a bottom and a side wall, which define the inside of the body, the side wall connected to both, and separating, the bottom and the top, wherein the top, the bottom and the side wall form an inner space of the body, the body further comprising a block associated with the side wall, the block having a front surface, a back surface, a top portion and a bottom portion, the block having at least one through hole, the through hole having a longitudinal axis running in the direction of the inner space and extending from the front surface to the back surface, the through hole having at its end an opening on the front surface, the opening defined by a perimeter, wherein the perimeter of the opening on the front surface is on a plane which is off set from a plane which is perpendicular to the longitudinal axis of the through hole, and a neck having a first end and a second end, the first end being connected to the block, wherein the first end of the neck faces the back surface of the block, the first end of the neck having at least one hole aligned with the at least one through hole of the block.

2. The instrument of claim 1, the top portion having a first thickness between the front and back surfaces and the bottom portion having a second thickness between the front and back surfaces, wherein the first thickness is greater than the second thickness.

3. The instrument of claim 1, wherein the front surface of the block is angled relative to the back surface from the top portion to the bottom surface, wherein the top portion is thicker than the bottom portion.

4. The instrument of claim 1, wherein the neck is connected to the block via at least one threaded bolt extending through the at least one through hole in the block and into the at least one hole of the first end of the neck.

5. The instrument of claim 4, wherein there are two through holes extending from the front surface to the back surface and the first end of the neck having two holes aligned with the two through holes of the block, wherein the neck is connected to the block via two threaded bolts extending through the block, each in a separate through hole, and into the corresponding holes of the first end of the neck and wherein each through hole having a longitudinal axis running in the direction of the inner space and extending from the front surface to the back surface, each through holes having at its end opening on the front surface, the opening defined by a perimeter, wherein the perimeter of the opening on the front surface is on a plane which is off set from a plane which is perpendicular to the longitudinal axis of the through hole.

6. The instrument of claim 5, wherein the front surface is substantially off set relative to the back surface.

7. The instrument of claim 5, wherein a portion of the sidewall is between the block and the first end of the neck.

8. The instrument of claim 5, wherein the first end of the neck comprises a tongue and a connecting brace, the tongue and the connection brace being generally perpendicular to one another, wherein the tongue extends over the top of the body and the connection brace faces the back surface of the block and wherein the two holes of the neck are in the connection brace.

9. The instrument of claim 8, wherein the through holes of the block and the holes in the neck are substantially perpendicular to the back surface of the block and the sidewall.

10. The instrument of claim 9, the tongue and the connection brace forming an inner corner, wherein the bolts, when tightened, urge a portion of the body into the inner corner.

11. The instrument of claim 1, wherein the neck is connected to the block via a threaded bolt having a head, the bolt being screwed into the through hole such that the head of the bold is urged against the perimeter of the opening.

* * * * *